US007797864B2

(12) United States Patent
Larson

(10) Patent No.: US 7,797,864 B2
(45) Date of Patent: Sep. 21, 2010

(54) STATIC FRAME RETENSION DEVICE

(76) Inventor: James D. Larson, 14517 Fryelands Blvd. SE., Monroe, WA (US) 98272

( * ) Notice: Subject to any disclaimer, the term of this patent is extended or adjusted under 35 U.S.C. 154(b) by 0 days.

(21) Appl. No.: 12/059,039

(22) Filed: Mar. 31, 2008

(65) Prior Publication Data

US 2008/0235999 A1 Oct. 2, 2008

Related U.S. Application Data

(63) Continuation-in-part of application No. 11/694,448, filed on Mar. 30, 2007, now abandoned.

(51) Int. Cl.
*D06C 3/08* (2006.01)
*B41C 1/14* (2006.01)

(52) U.S. Cl. ..... 38/102.21; 101/127.1; 38/102.91

(58) Field of Classification Search ..... 101/127.1; 38/102.4, 102.21, 102.91; 160/371–403; 40/603, 604

See application file for complete search history.

(56) References Cited

U.S. PATENT DOCUMENTS

| | | | | | |
|---|---|---|---|---|---|
| 2,218,451 | A * | 10/1940 | Heyne | 101/415.1 |
| 4,937,961 | A * | 7/1990 | Gandy et al. | 40/603 |
| 5,379,691 | A * | 1/1995 | Hamu et al. | 101/127.1 |
| 5,408,770 | A * | 4/1995 | Suzuki | 38/102 |
| 5,676,052 | A * | 10/1997 | Wegrzyn et al. | 101/127.1 |
| 5,802,971 | A * | 9/1998 | Hamu et al. | 101/127.1 |
| 5,983,790 | A * | 11/1999 | Switzer et al. | 101/127.1 |
| 6,192,611 | B1 * | 2/2001 | Molla | 40/604 |
| 6,564,488 | B2 * | 5/2003 | Wittenberg | 40/603 |
| 6,698,123 | B2 * | 3/2004 | Smith | 40/603 |
| 6,785,047 | B1 * | 8/2004 | Risher | 359/443 |

* cited by examiner

*Primary Examiner*—Ismael Izaguirre
(74) *Attorney, Agent, or Firm*—Robert A. Jensen; Jensen & Puntigam, P.S.

(57) ABSTRACT

A modified static silkscreen frame including elongated elements on the upper surface of each frame element to mate with downwardly facing securement elements along the edge of a silkscreen panel, such that the panel may be properly tensioned and retensioned as necessary.

9 Claims, 8 Drawing Sheets

STATIC FRAME RETENSION DEVICE

PRIOR APPLICATION

This invention is a continuation-in-part of U.S. patent application Ser. No. 11/694,448 filed Mar. 30, 2007.

TECHNICAL FIELD

This invention relates to the silkscreen industry, and more particularly, a device for tensioning and securing a silkscreen panel to a static frame and for retensioning said panel.

BACKGROUND OF THE INVENTION

The art and trade of silkscreening has existed for many years. Initially the silkscreen transfer was done via a silkscreen panel secured to a static frame and the tension on the panel was generated by hand and the panel secured by glue. Although these original wooden panels had many drawbacks, many are still in use today, along with static frames made of aluminum. More recently, aluminum frames made of rotatable tubular material allowed the operator to control the tension of the panel and in fact allowed the operator to retension the panel when it had become somewhat slack through use and age.

Although many advances have been made in the silkscreen industry over the years, including the above-noted roller frame and automatic machines, which, although expensive, allowed more control and more production. A large number of operators still use static frames in one form or another.

DISCLOSURE OF THE INVENTION

With the above-noted history and prior art in mind, one of the benefits of the present invention is in allowing the owners of static frames to tension and install a pre-cut panel, thus saving a great deal of time and reducing waste.

Another advantage of the present invention is that it allows an operator to retension a panel on a static frame.

Yet another advantage of the present invention is that it results in a static frame which is adapted for use with a pre-cut screen panel.

Yet a further advantage of the present invention is that through the use of a pre-cut panel, it assures that the tension on the panel is appropriate during use.

BEST MODE FOR CARRYING OUT THE INVENTION

Figure 1:
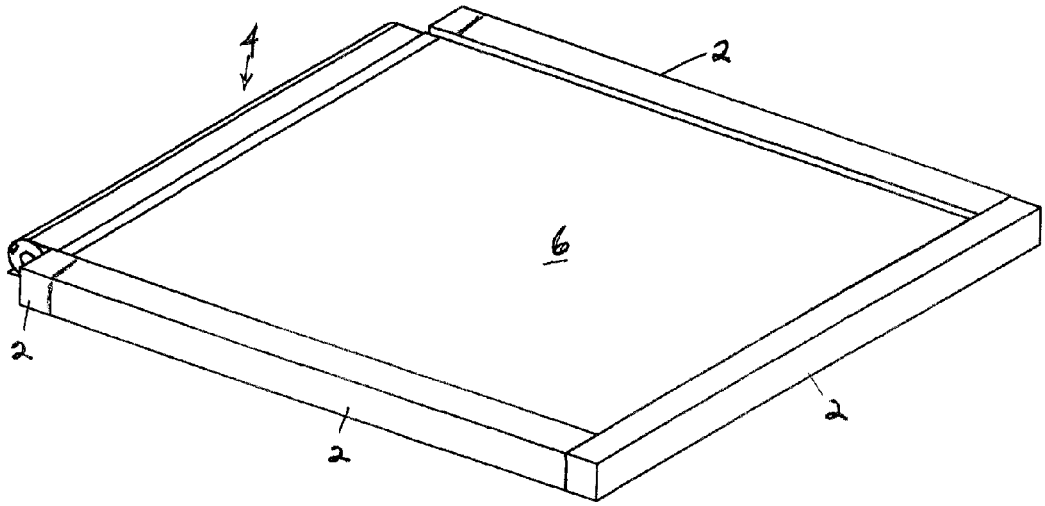
FIG. 1 is an isometric view of a static panel with the inventive tensioning device in position.
Figure 2:
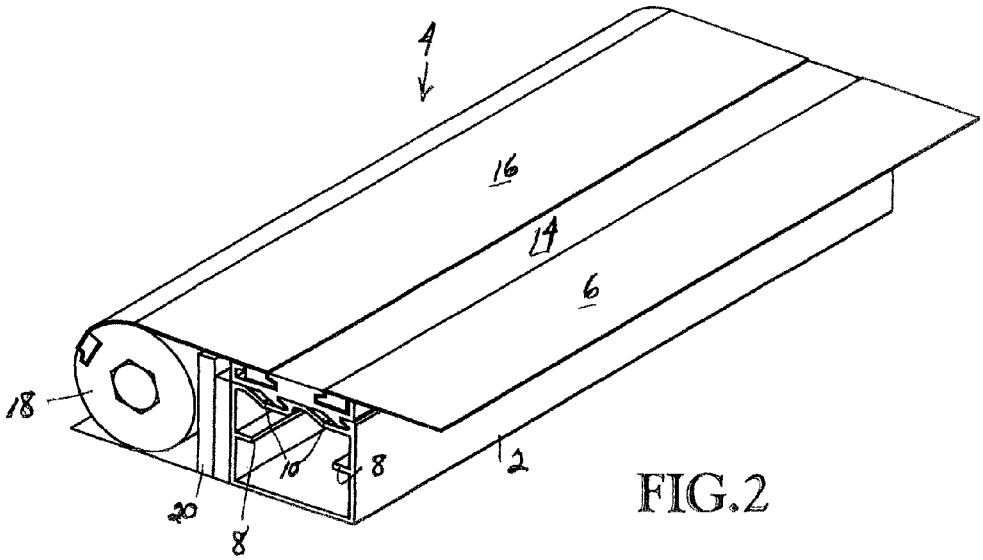
FIG. 2 is a partial section through one side of the static frame showing the tensioning device and the tandem securement device.
Figure 3:
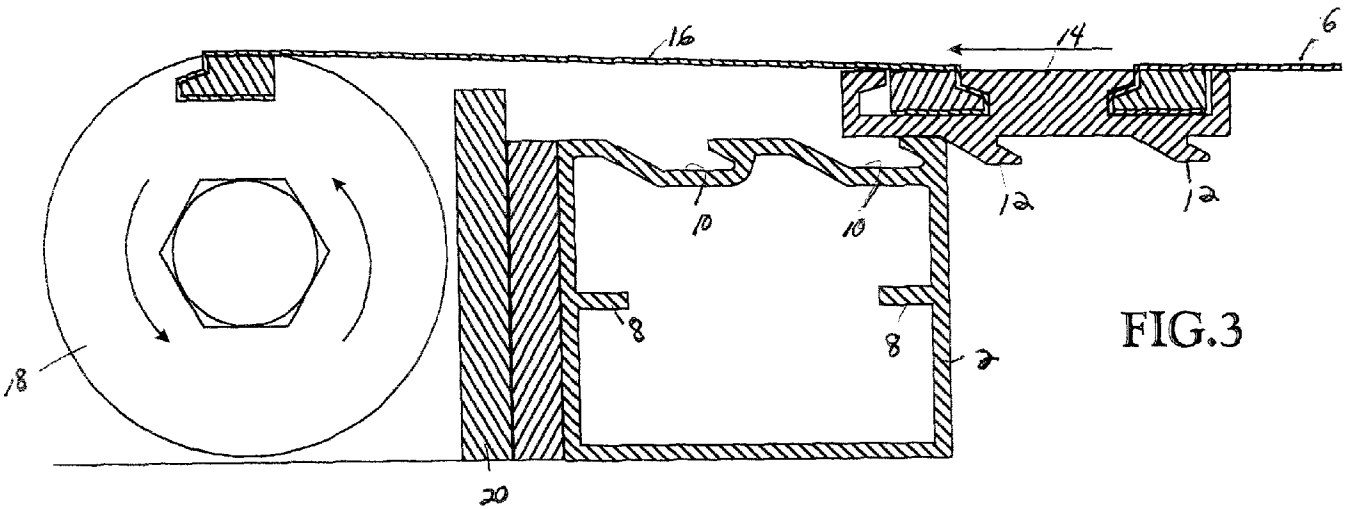
FIGS. 3-6 are sectional views showing the stretching device and tandem device in conjunction with one side of a static frame.
Figure 4:
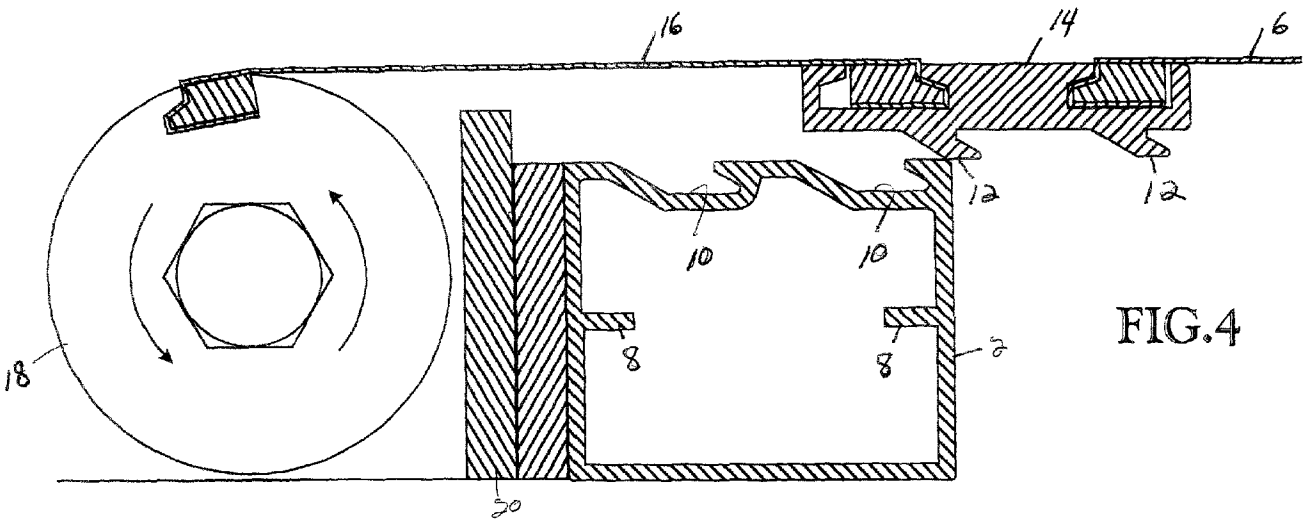
Figure 5:
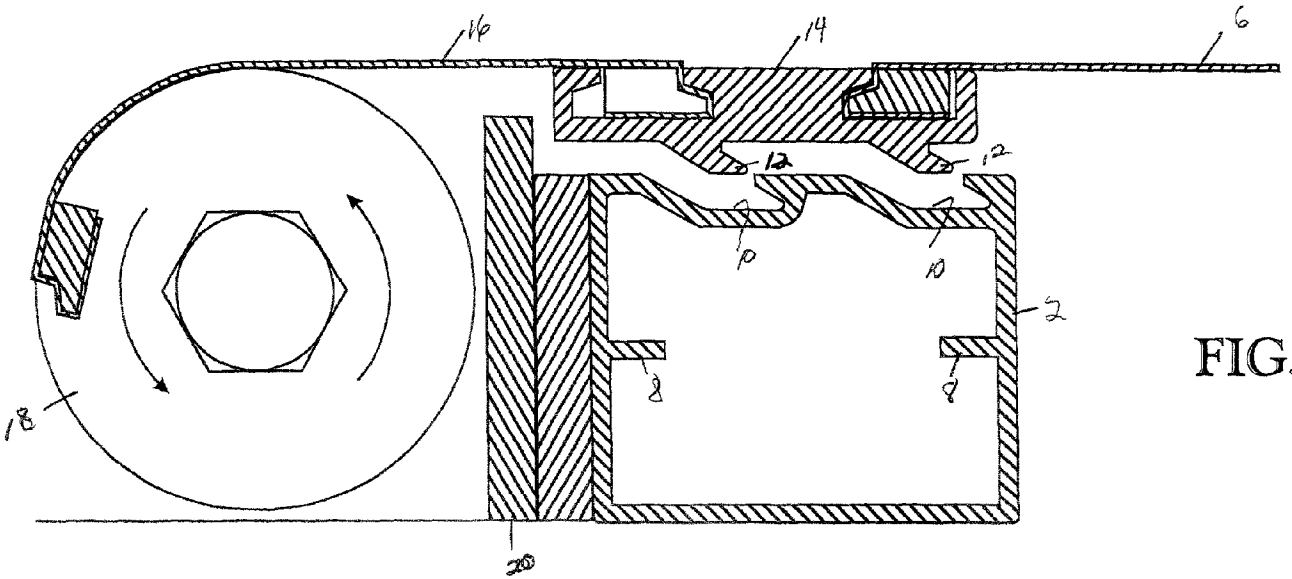
Figure 6:
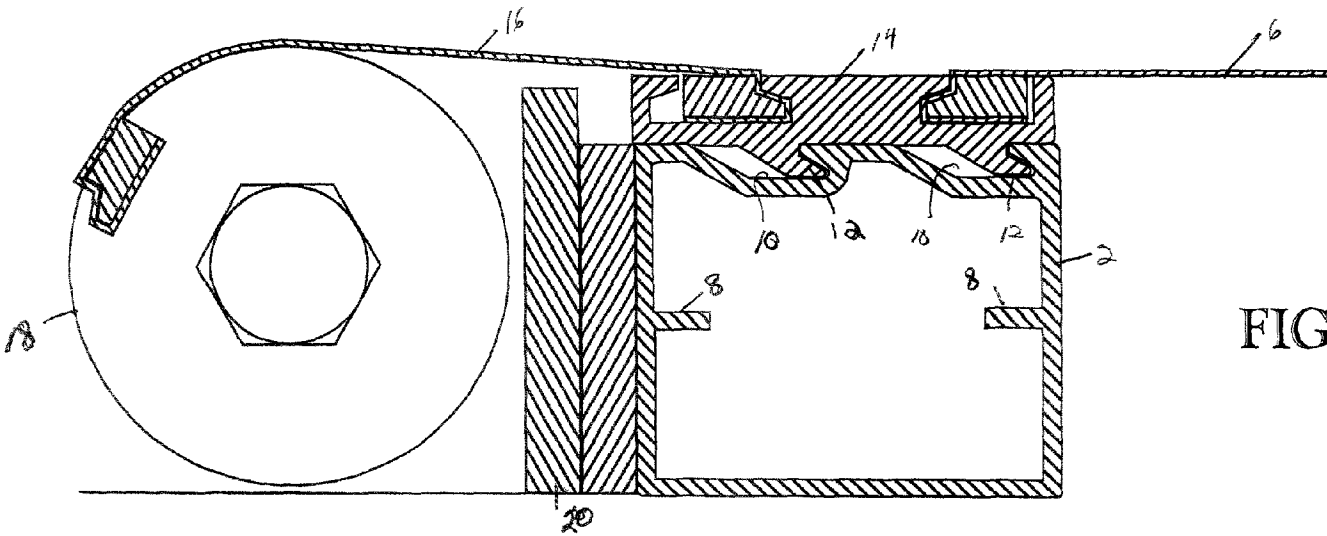

As seen in FIG. 1, the static frame includes four identical sides 2 and further includes a stretching device generally designated as 4 to be described in greater detail with respect to FIG. 2, as well as a silkscreen panel 6 which is being stretched and attached by stretching unit 4.

As seen in FIG. 2, the frame element or side 2 includes internal reinforcing ribs 8 and a pair of upwardly and outwardly facing grooves 10 to receive downwardly facing tabs 12 on tandem unit 14. Tandem element 14 is more completely described in U.S. patent application Ser. No. 11/470,891, which is incorporated herein by reference. Tandem unit 14 serves as an interconnect with the frame member as well as with the silkscreen panel 6, a connecting web 16, which in turn is removably secured through roller 18 which as described hereinafter serves to provide tension to the screen by sequentially moving from one edge of the frame to another tensioning the screen at each station until all four sides are stretched and secured. Also seen in this view is a stop 20 to prevent over tensioning of the panel 6.

Reference is now had to FIGS. 3-6, wherein identical numerals are utilized and the sequence of placing the panel 6 secured to tandem unit 14 on the edge of frame 2 and then rotating roller 18 to cause the tandem 14 to move to the left in these views until it overlies the grooves 10 at which point it is physically moved downwardly and locks into the grooves 10. Upon the release of the tension, the foot which secures the intermediate member 16 is released and the frame rotated through 90° or 180° and a second side of the panel is attached. This is repeated until all sides of the panel are stretched and attached. Also seen in this view is a stop member 22, which assures that the frame side element 2 remains straight during the stretching process.

Figure 7:
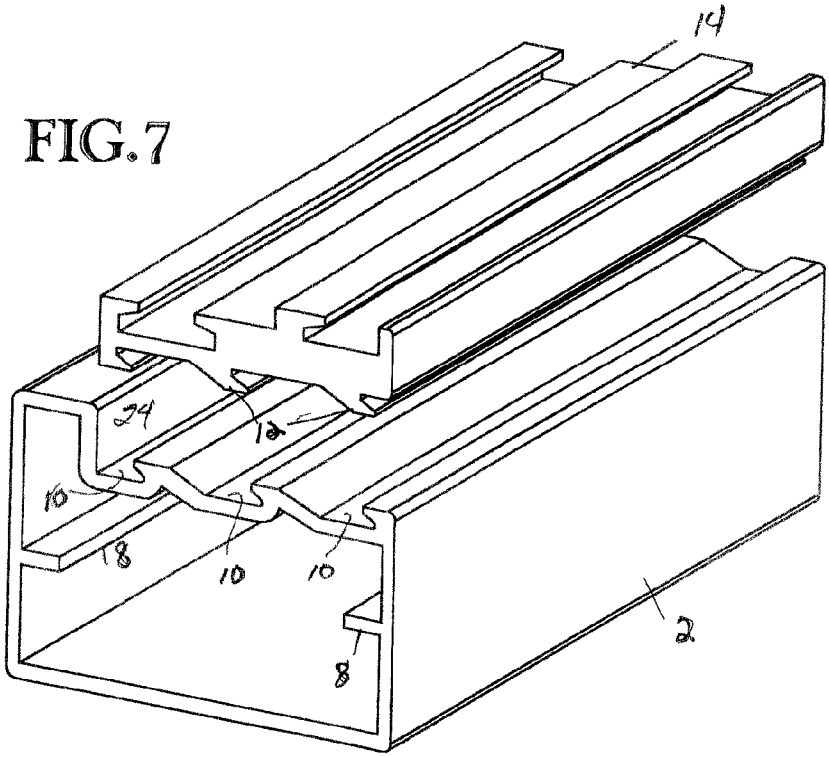
FIG. 7 is a partial section showing a frame element having a stop to prevent over tension used in conjunction with a special tandem unit.
Figure 8:
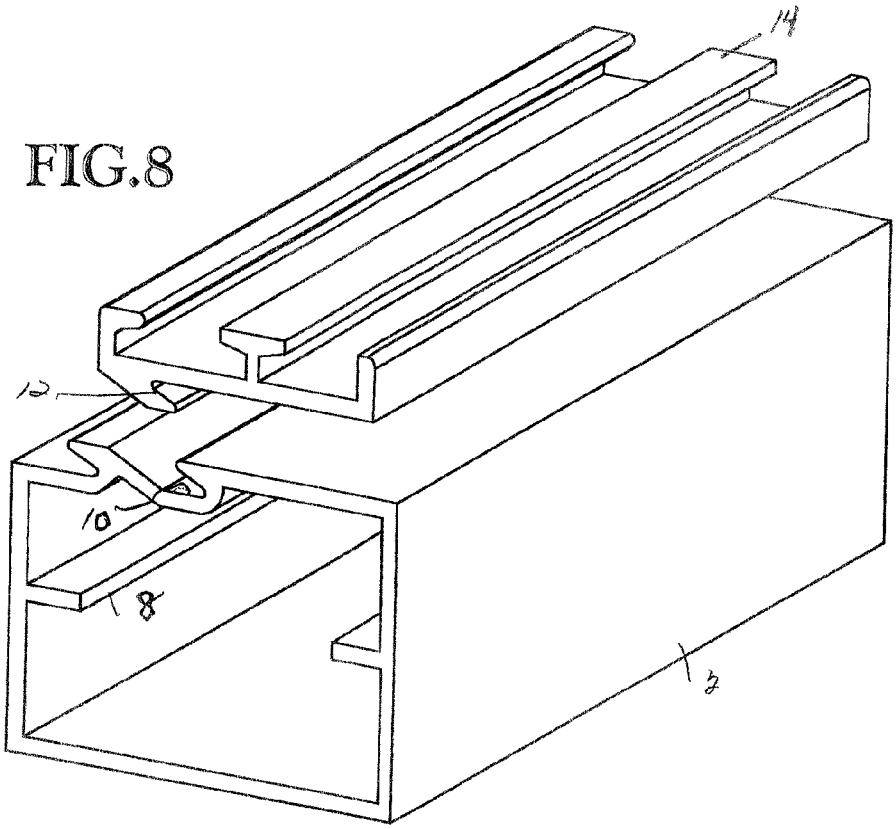
FIG. 8 depicts a partial section view showing a frame and tandem unit which is appropriate for retensioning the screen panel.
Figure 9A:
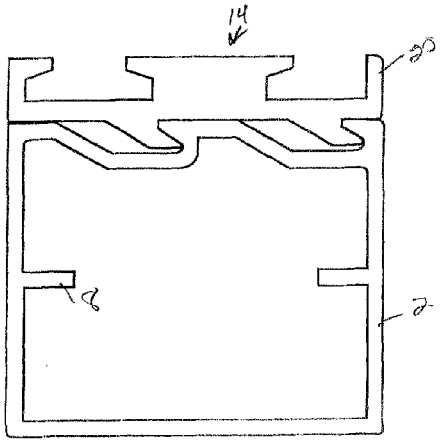
FIG. 9, parts A through D, show one method for retensioning a panel on a static frame.
Figure 9B:
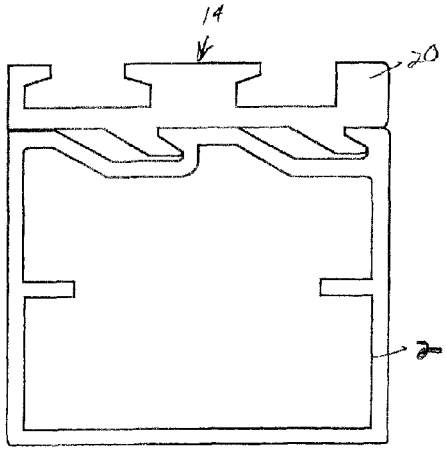
Figure 9C:
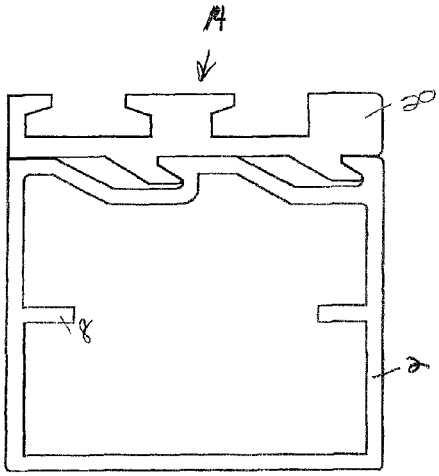
Figure 9D:
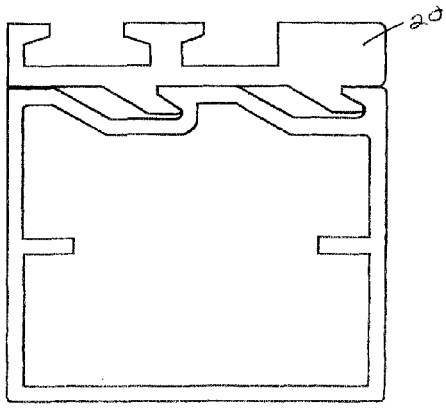

Reference is now had to FIGS. 7 and 8, wherein alternate configurations of the frame element 2 are shown as well as possible alterations of the tandem element. As seen in FIG. 7, the top part of the frame element 2 includes 3 grooves as well as an integral stop mechanism 24. Tandem unit 14 has the screen receiving groove at an elevated plane relative to the web receiving groove.

As seen in FIG. 8, the tandem element 14 includes only one downwardly depending ledge which interacts with either of the two grooves 10 in the top of frame element 2, thereby permitting retensioning, but includes a larger horizontal surface for stability.

Reference is now had to FIG. 9, parts A through D, wherein it can be seen that the right shoulder 20 of tandem 14 gets sequentially wider allowing retensioning because of the greater distance between the opposite sides of the screen panel.

Figure 10:
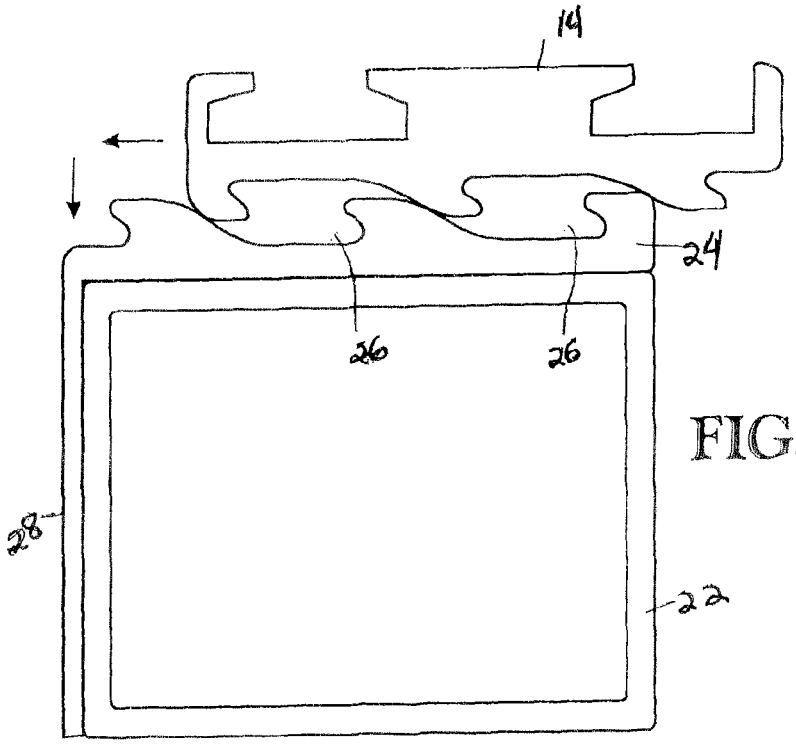
FIGS. 10 and 11 depict two possible methods of retrofitting a static frame to adapt to the present technology and method of securing mesh panels to static frames.

FIG. 10 depicts a standard hollow aluminum static frame as seen in cross section, however, it is retrofit with an inverted L-shaped section 24 including the backward downward grooves 26 as well as a reinforcing dependent flange 28 such that it can accept the tandem unit 14. The retrofit element 24,26,28 can be welded or glued to the frame element 22.

Figure 11:
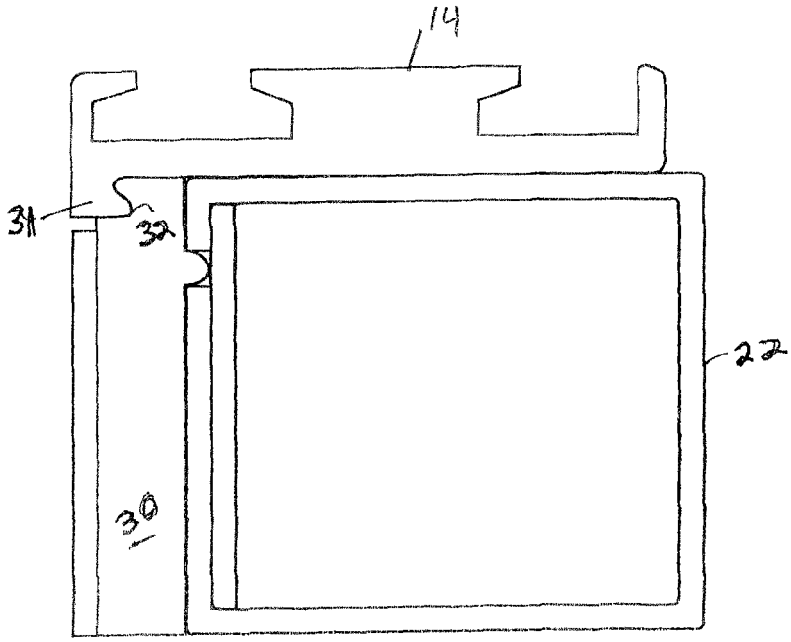

Another possible retrofit is shown in FIG. 11, wherein the outer surface of frame element 22 and is reinforced as at 30 and includes a horizontal groove 32 to accept the depending foot 34 of modified element 14.

Figure 12:
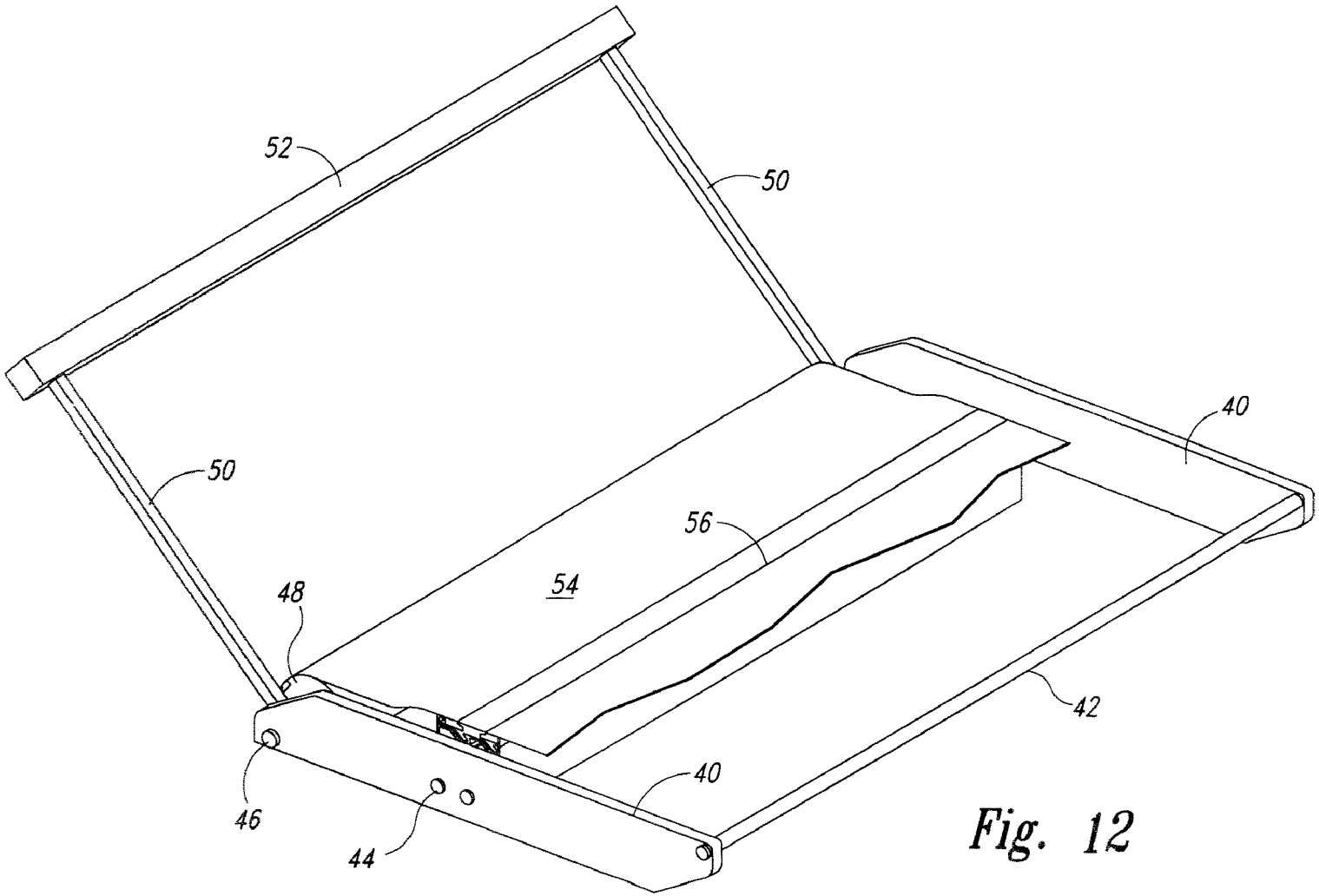
FIG. 12 is a view of a stretching device.

As seen in FIG. 12, a preferred stretching device includes a pair of side rails 40 joined at the front end by a crossbar 42 located at a height such that the silkscreen frame may be placed beneath the crossbar 42 during the stretching, thereby preventing upward movement of the frame. Approximately midway of the side rails 40 are additional crossbars 44 which serve to not only rigidify the tensioning device, but also serve as a stop placing the stretching frame in the appropriate position for screen application. At the rear of side members 40 is another crossbar, which serves to stabilize the stretching member as well as serving as an axle for the tensioning tube 48, to which is secured a pair of arms 50 and a handle 52. Removably mounted to the stretching tube 48 is a web piece 54 to which is secured a linking member 56, otherwise known as a tandem unit.

In operation, the leading edge of the screen to be attached is secured to the tandem unit 56 when the handle is in its forwardmost position, and then the handle is rotated to its down position, stretching the fabric until it can be snapped into the appropriate frame element.

Figure 13:
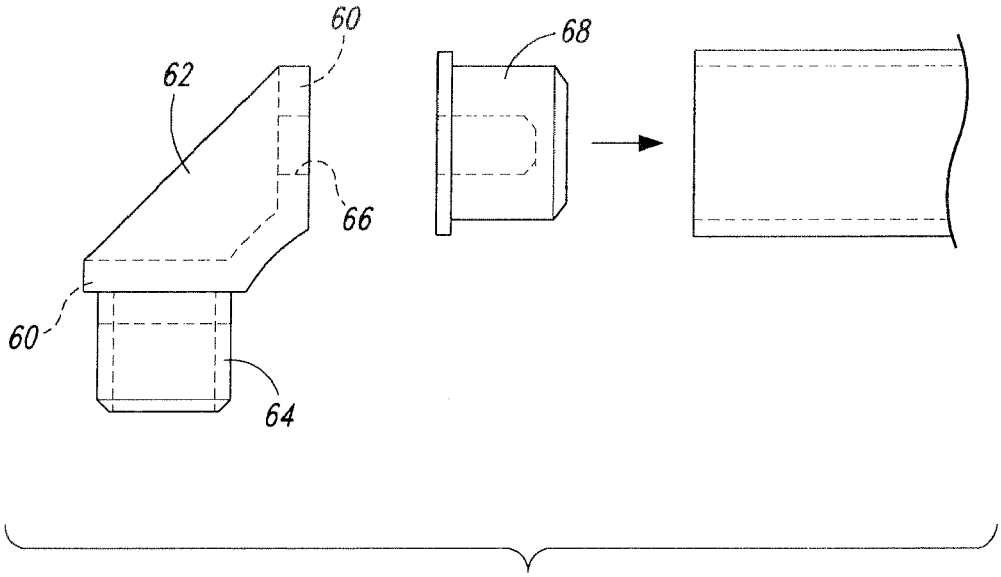
FIG. 13 is a view of a frame corner construction.

FIG. 13 illustrates one method of fabricating the frame in an inexpensive manner which allows for shipping in a collapsed condition. The frame tubes are joined at the intersection with a die-cast corner having a pair of perpendicular flange members 60 interconnected by web elements 62, and having one of the flange elements having integrally connected thereto a hollow tube element 64, slightly tapered to receive the other end of a tube which is pressed and glued. The opposite flange includes a through-hole 66 which serves to mechanically connect it to a die-cast plug 68, interiorly tapped and designed to receive the perpendicular frame tube, again pressed and glued.

Thus, as can be seen, the present invention gives the owner of a static silkscreen frame the ability to carefully control the tension on the silkscreen panel, as well as providing a means for quickly and efficiently installing the panel on the frame, and further has the ability to allow the retensioning of the frame.

The invention claimed is:

1. A retensionable static printing frame for silk screening comprising:

rigid elongated peripheral elements forming a rectangular printing frame capable of withstanding the tension necessary for silk screening, wherein each element includes at its upper surface at least one longitudinal groove; and rigid elongated connecting elements, one for each peripheral element, said connecting elements including at least one elongated ridge, adapted for mating to the groove in the peripheral element, hereinafter mating elements, on its bottom surface and two parallel grooves on its upper surface, one to receive the edge of a silkscreen panel and one to receive the edge of a strip of flexible extension material whereby the connecting element may be moved laterally relative to the peripheral element to retension the silkscreen panel.

2. A frame as in claim 1, wherein either the peripheral elements or the connecting elements include more than one mating element.

3. Means for attaching and retensioning a silkscreen fabric on a static frame member comprising:

a rectangular frame element including four sides, each of said sides including first securement means on the upper surface thereof;

elongated tandem elements for removable securement to the sides of the frame, said tandem elements including second securement means on the underside of the tandem means to mate with the frame; and said mating allowing instant release and allowing relative lateral movement in an outward direction to retension the screen, said tandem elements further including means for securement to a silkscreen and to a tensioning means.

4. A means as in claim 3, and further including means preventing over-tensioning of the fabric.

5. A method of securing and retensioning a pre-cut bordered a silkscreen fabric to a static frame, comprising the steps of:

(a) Placing the frame including upwardly facing locking means with one side adjacent a tensioning device;

(b) Securing one edge of a precut and peripherally bordered silkscreen fabric into a securement means;

(c) Securing a tensioning means to the securement means;

(d) Applying tension to the screen;

(e) Securing the edge to the frame utilizing the locking means; and (f) Repeating for the remaining sides and edges.

6. The method of preparing a silkscreen for printing, comprising the steps of:

(a) cutting the mesh to a predetermined size and shape such that when the screen is placed upon the appropriate frame, the tension on the screen will be substantially equal across its surface;

(b) securing a flexible strip to each edge of the configured mesh;

(c) placing a frame including pre-calibrated securement means adjacent a stretching device; and (d) sequentially stretching and securing each edge of the screen to the frame at a predetermined tension.

7. The method as in claim 6, wherein the tension is between 10 and 50 joules.

8. The method as in claim 6, including securing the screen to a separate stretching member for each edge.

9. The method as in claim 8, wherein the stretching member is relatively fixed, rotating the frame and screen for stretching each edge.

* * * * *